US006135026A

United States Patent [19]

Kalbantner et al.

[11] Patent Number: 6,135,026

[45] Date of Patent: Oct. 24, 2000

[54] SHEET GUIDING DEVICE IN A SHEET-FED PRINTING PRESS

[75] Inventors: Jens Kalbantner, Mannheim; Josef Wehle, Gaiberg, both of Germany

[73] Assignee: Heidelberger Druckmaschinen Aktiengesellschaft, Munich, Germany

[21] Appl. No.: 09/299,896

[22] Filed: Apr. 27, 1999

[30] Foreign Application Priority Data

Apr. 27, 1998 [DE] Germany ..... 198 18 742

[51] Int. Cl.[7] ..... B41F 13/24

[52] U.S. Cl. ..... 101/232; 101/272

[58] Field of Search ..... 101/232, 272, 101/216, 219, 275, 248; 271/264, 275, 276, 195, 314

[56] References Cited

U.S. PATENT DOCUMENTS

| | | | |
|---|---|---|---|
| 4,491,854 | 1/1985 | Habelt et al. | 346/136 |
| 5,421,257 | 6/1995 | Okuda et al. | 101/137 |
| 5,476,041 | 12/1995 | Czotscher | 101/232 |
| 5,816,155 | 10/1998 | Stephen | 101/232 |

*Primary Examiner*—John S. Hilten
*Assistant Examiner*—Darius N. Cone
*Attorney, Agent, or Firm*—Herbert L. Lerner; Laurence A. Greenberg; Werner H. Stemer

[57] ABSTRACT

A sheet guiding device assemblable from at least a first sheet guiding element and a second sheet guiding element, for guiding sheets of printing material in a sheet-fed printing press, includes a guide for guiding at least one of the sheet guiding elements as the sheet guiding elements are being mutually assembled.

14 Claims, 5 Drawing Sheets

57
18
49,55
51
25
α

22
58
49,55
18
57
60
51
α
61
59
51
25

SHEET GUIDING DEVICE IN A SHEET-FED PRINTING PRESS

BACKGROUND OF THE INVENTION

Field of the Invention

The invention relates to a sheet guiding device assemblable from a first sheet guiding element and a second sheet guiding element, for guiding sheets of printing material in a sheet-fed printing press.

In sheet-fed printing presses, sheet guiding devices are used for smear-free transport of sheets of printing material. In this regard, the sheets of printing material, during the transport thereof, slide directly on sheet guiding elements, or on a blown air cushion generated on the sheet guiding elements, so that the sheets of printing material are held, for example, at the circumference of a transport drum that transports them. In this manner, cardboard or pasteboard sheets of high flexural strength can be transported very reliably. Such sheet guiding devices must be cleaned at regular intervals to remove smeared-off printing ink and paper dust adhering thereto.

In the German Utility Model DE 297 10 252 U1, a guiding device for sheet-type printing materials or printing stock is described, the guiding device having a continuous surface formed by a plurality of guide baffles. A guide can also be provided, in which a guide baffle is braced so as to be able to exercise a thrusting or sliding movement. A hinge-type swivel joint can also be braced on the guide. Alternatively, the guide can be formed, on the frame side, as a groove in which the guide baffle slides with a thrusting movement through the intermediary of bolts.

In the aforedescribed device of the prior art, the guide baffles are supported in swivel joints fixed to the frame. The guide baffles are not assemblable, nor is the guide constructed accordingly. With this guiding device, good accessibility to the sheet guiding cylinder is indeed attained, but maintenance of the guiding device itself involves complicated and expensive dismantling work. For thorough cleaning of the guiding device, it is advantageous for it to be removable from the printing press. This is possible here only if the hinges are loosened by tools, which in practice is very time-consuming. The guiding device is assigned to the middle one of three serially arranged sheet-guiding cylinders, and is disposed thereabove. The guiding device is structurally unsuitable for a disposition in the region below the sheet guiding cylinder, and thus cannot be used for printing presses in which there is only a single sheet transfer drum between the impression cylinders of two printing units. In that case, due to the direction of rotation of the sheet transfer drum, the sheet of printing material is in fact transported by the sheet transfer drum underneath the latter. The described guiding device is indeed especially well suited to bending-resistant materials, but is less well suited for thin, unstable printing materials.

In German Utility Model DE 295 01 537 U1, there is described a sheet guiding device with air supply chests or cases, which is the closest prior art to the invention. The sheet guiding device can be disposed below a transfer drum which, as the only drum, transports the sheet of printing material between two printing units and the impression cylinders thereof. The guide surfaces of the sheet guiding device are assemblable from modules. The modules are assembled during the erection of the printing press. No guidance is provided for facilitating a simple and rapid assembly and disassembly of the modules. The printing press must be partly dismantled and the transfer drum must be removed because the sheet guiding device is otherwise not accessible for cleaning.

SUMMARY OF THE INVENTION

It is accordingly an object of the invention to provide a sheet guiding device that is quickly and reliably assemblable. With the foregoing and other objects in view, there is provided, in accordance with one aspect of the invention, a sheet guiding device assemblable from at least a first sheet guiding element and a second sheet guiding element, for guiding sheets of printing material in a sheet-fed printing press, comprising a guide for guiding at least one of the sheet guiding elements as the sheet guiding elements are being mutually assembled.

In accordance with another feature of the invention, the guide is capable of guiding a plurality of sheet guiding elements as they are being mutually assembled.

In accordance with a further feature of the invention, the first sheet guiding element and the second sheet guiding element, respectively, have a first mounting support and a second mounting support.

In accordance with an added feature of the invention, each of the first mounting supports includes a blocking part and a blocking part seat.

In accordance with an additional feature of the invention, at least one second mounting support is embodied as a turning and sliding joint.

In accordance with yet another feature of the invention, the sheet guiding device includes at least one third sheet guiding element insertable between the first sheet guiding element and the second sheet guiding element, and guidable by the guide as the first and second sheet guiding elements and the third sheet guiding element are being mutually assembled.

In accordance with yet a further feature of the invention, the sheet guiding device includes at least one third sheet guiding element insertable between the first and the second sheet guiding elements, and guidable by the guide as the first and the second sheet guiding elements and the third sheet guiding element are being mutually assembled, the third sheet guiding element having two mounting supports embodied like the second mounting support of the first and the second sheet guiding elements.

In accordance with yet an added feature of the invention, at least one of the sheet guiding elements is formed so as to be self-locking while the sheet guiding elements are being mutually assembled.

In accordance with yet an additional feature of the invention, the first sheet guiding element and the second sheet guiding element are assigned to either a sheet transport drum or a cylinder for guiding a sheet of printing material.

In accordance with still another feature of the invention, at least one of the sheet guiding elements is embodied as a sheet guiding baffle provided with nozzles, and the sheet guiding device includes a radial fan for supplying the nozzles with blown air.

In accordance with still a further feature of the invention, at least one of the sheet guiding elements is disposed so that, as viewed in sheet transport direction, a leading edge thereof is offset, in a direction of a normal to a sheet guide plane, from a trailing edge of a sheet guiding element preceding the one sheet guiding element in the sheet transport direction.

In accordance with still an added feature of the invention, the guide is formed so as to curve concentrically around either the sheet transport drum or the cylinder.

In accordance with a concomitant aspect of the invention, there is provided a printing press having at least one of the sheet guiding devices provided with at least one of the foregoing features.

The sheet guiding device, which is embodied so that it can be put together from a first sheet guiding element and a second sheet guiding element, for guiding sheets of printing material or stock in a sheet-fed printing press, has a guide for guiding at least one of the sheet guiding elements while the sheet guiding elements are being put together. Because of the guide that guides at least one of the sheet guiding elements as they are being put together, rapid assembly of the sheet guiding device by the pressman is provided for. The guide can preferably guide the at least one sheet guiding element when the sheet guiding device is being taken apart, as well, so that dismantling can be performed in a very operationally safe or reliable manner. The at least one sheet guiding element guided by the guide is preferably that sheet guiding element, of the at least two sheet guiding elements which can be put together, the operating position of that sheet guiding element having an especially poor accessibility and being obstructed by other machine parts, for example, a sheet transport drum. The other sheet guiding element, the inserted position of which is more readily accessible, can be put together, itself unguided, with the guided sheet guiding element. A sheet guiding device of this type can be so constructed that it can be put together especially simply and variably. A plurality of different interchangeable embodiments may be provided for the first and/or second sheet guiding element. For example, a sheet guiding element embodied as a sheet guide baffle with nozzles can very quickly be exchanged for one with a different arrangement of nozzles, if a change of the type of printing material, such as from lightweight paper to heavy cardboard, requires it.

An embodiment that further refines the invention calls for the sheet guiding device to have a guide that guides a plurality of sheet guiding elements as they are being put together. This embodiment is especially advantageous if the operating position of a plurality of sheet guiding elements that can be put together is rather poorly accessible to the operator. Instead of a preferably single guide that guides the plurality of sheet guiding elements, each of the plurality of sheet guiding elements may be guided by a separate guide; the various separate guides can then be embodied differently from or identically to one another.

All of the guides described in the foregoing embodiments are capable of guiding the sheet guiding element or sheet guiding elements in and/or counter to the sheet transport direction, that is, in the direction of the printing length, and perpendicular to the sheet transport direction, that is, in the direction of the printing width. For example, a guide assigned to a sheet transport drum and guiding a sheet of printing material being transported by the sheet transport drum can guide the sheet guiding elements either parallel to the axial direction of the drum or preferably parallel to the circumferential direction of the drum, depending upon the directions in which the sheet guiding elements are put together.

In a further embodiment, the first sheet guiding element and the second sheet guiding element each have a first mounting support and a second mounting support. Sheet guiding elements embodied in this manner can be fixed very precisely in the operating position thereof. Preferably, each mounting support comprises one element that belongs to the guide or is embodied thereon, and one element that belongs to the sheet guiding element or is embodied thereon. Each of the sheet guiding elements may be provided with only one such first mounting support, while the second mounting support serves to connect the two sheet guiding elements to one another and comprises a part that belongs to the first sheet guiding element and to the second sheet guiding element. In this case, the second mounting support may, for example, be profiled in such a manner that the sheet guiding elements can be inserted partly into one another, and mutually brace and fix one another. Via such mounting supports, a third sheet guiding element, which can optionally be inserted between the first and second sheet guiding elements, may also be connected in a form-locking manner to the first and second sheet guiding elements. In this regard, it is noted that a form-locking connection is one which connects two elements together due to the shape of the elements themselves, as opposed to a force-locking connection, which locks the elements together by force external to the elements. The first and second mounting supports are preferably disposed, offset from one another in the sheet transport direction, on respective sheet guiding elements and the guide, and are constructed differently from one another.

In a further embodiment, each of the first mounting supports includes a blocking part and a blocking part seat. By this type of form-lockingly acting first mounting support, the sheet guiding elements can be secured against unintended loosening or release thereof from the operating position. A friction-locking first mounting support, for example, a clamping device, may also be provided.

In a further embodiment, at least one and preferably every other mounting support is embodied as a turning and sliding joint. Such a mounting support allows both pivoting about a pivot axis of the joint, and displacement of the paired joint parts relative to one another inside the joint, and has a degree of freedom of at least two. The displacement can be performed in the axial direction of the pivot axis of the joint, for example, when there are sheet guiding elements which are insertable into the press in the lateral direction, crosswise to the printing direction in the guide, and which are additionally pivotable in the printing direction about the pivot axis. Preferably, the pivot axis or a pivot pin forming the pivot axis is displaced at right angles to the axial direction of this axis or pin, for example, in the printing direction. A sheet guiding device embodied in this manner can be put together especially favorably for the case wherein it is disposed near a sheet transport drum assigned to the sheet guiding device. The guide path formed by the thus mutually assembled sheet guiding elements of this sheet guiding device can be disposed concentrically to the circumferential surface of the sheet transport drum and facing towards it, and can preferably extend approximately equidistant to the circumferential surface. A sheet guiding device that includes at least one turning and sliding joint is especially well suited for disposition in a poorly accessible position under the sheet transport drum.

In a further embodiment, the sheet guiding device includes at least one third sheet guiding element which can be inserted between the first sheet guiding element and the second sheet guiding element and is guided by the guide as the sheet guiding elements are put together. It is also possible for a plurality of sheet guiding elements to be provided which are inserted between the first and second sheet guiding elements and are guided by the guide. Constructing the sheet guiding device of more than two parts makes it simpler to put together large, bulky sheet guiding devices inside the press. This is especially helpful, for example, if the sheet guiding device is associated with a multiple-size sheet transport drum with a long circumferential length, i.e., a drum having a diameter that is a multiple of the diameter of a conventional printing unit cylinder, such as an impression, plate and blanket cylinder. In that case, the sheet guiding elements of a sheet guiding device embodied of two parts can become too inconvenient to handle in assembly and in many cases, because of the tight space conditions present, can be introduced only rather poorly into the operating position thereof along the circumferential line of the drum. The sheet guiding device is preferably made of three parts, comprising precisely three sheet guiding elements. This makes it convenient to put together the sheet guiding elements and take them apart, at limited production costs.

In a further embodiment, the third sheet guiding element has two mounting supports, which are embodied like, or substantially identically to, the second mounting support of the other sheet guiding elements. Such an embodiment lessens the engineering effort and expense, and the third sheet guiding element can be assembled very precisely with the other two sheet guiding elements. Each mounting support of the third sheet guiding element can be embodied, together with the second mounting support associated therewith of the first or second sheet guiding element, in the form of a double mounting support; then part of the double mounting support is at the same time a component of the respective second mounting support and of the adjoining mounting support of the third sheet guiding element. For example, a guide part belonging to the first or second sheet guiding element can be received and guided simultaneously, together with a guide part belonging to the third sheet guiding element, between a pair of guide surfaces.

In a further embodiment, the first and/or second sheet guiding element is embodied as self-locking while it or they are being put together. Such an embodiment is absolutely operationally safe and precludes incorrect installation that would damage the press. The self-locking is effected by gravity on the respective sheet guiding element. Preferably, both the first and second sheet guiding elements are each embodied in self-locking fashion.

In a further embodiment, the first sheet guiding element and the second sheet guiding element are associated with a sheet transport drum or a cylinder that guides a sheet of printable material. If the third sheet guiding element, or a plurality of sheet guiding elements mounted between the first and second sheet guiding elements, are present, then all the sheet guiding elements together can form the sheet guiding device associated with the sheet transport drum or the cylinder.

In a further embodiment, at least one of the sheet guiding elements is embodied as a sheet guiding baffle provided with nozzles, and preferably a plurality of sheet guiding elements or all the sheet guiding elements of the sheet guiding device are so embodied. The nozzles may be supplied with blown air by at least one radial fan disposed on the respective sheet guiding element. Guide surfaces, provided with blown air nozzles, of the sheet guiding elements make possible especially gentle, nonsmearing guidance of the sheets of printable material by spacing the sheets from the guide surfaces. By using one or more radial fans disposed on the sheet guiding device, uniform air distribution is achieved with high efficiency.

In a further embodiment, two or more fans, preferably radial fans, per sheet guiding element are provided, which are disposed in or on chests below the sheet guiding element, and supply compressed air to separate chambers in the chest. Preferably, two chambers each with one fan are provided per sheet guiding element, and a plurality of sheet guiding elements or all the sheet guiding elements are so equipped. By assigning each of the fans to separate chambers, any unintended mutual influence of the fans is avoided, and a great deal of installation space is saved by disposing them directly on the sheet guiding element or on the chests that include the chambers.

In a further embodiment, at least one sheet guiding element is disposed so that, as viewed in the sheet transport direction, the leading edge thereof is offset, in a direction of a normal to the sheet guiding plane or sheet guiding surface, from the trailing edge of a sheet guiding element preceding it in the sheet transport direction, and preferably protrudes past the trailing edge. The leading edge of the first sheet guiding element can be cambered in ski jump fashion relative to the trailing edge of the preceding sheet guiding element. In this way, the sheet of printing material is prevented under all circumstances from smearing or even catching on a trailing edge of a sheet guiding element preceding it in the sheet transport direction. Even if there are inaccuracies of assembly and unintended shifts of position, this security is absolutely assured. The sheet guiding element preceding the first sheet guiding element in the sheet transport direction can be either the second or the third sheet guiding element. Preferably, the dividing or dismantling location of the third to the second sheet guiding element following this is, and other dividing locations of the sheet guiding device can be, constructed in an exactly like manner.

The trailing edge of the trailing sheet guiding element can also protrude past the leading edge of the following sheet guiding element; as a result, in some applications, favorable flow conditions of the supporting air can be attained thereby.

The invention can be used in any printing presses that process sheets of printing material, especially rotary printing presses, and, for example, in printing presses with in-line printing units and printing presses operating by various printing methods, such as offset printing presses.

Other features which are considered as characteristic for the invention are set forth in the appended claims.

Although the invention is illustrated and described herein as embodied in a sheet guiding device in a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
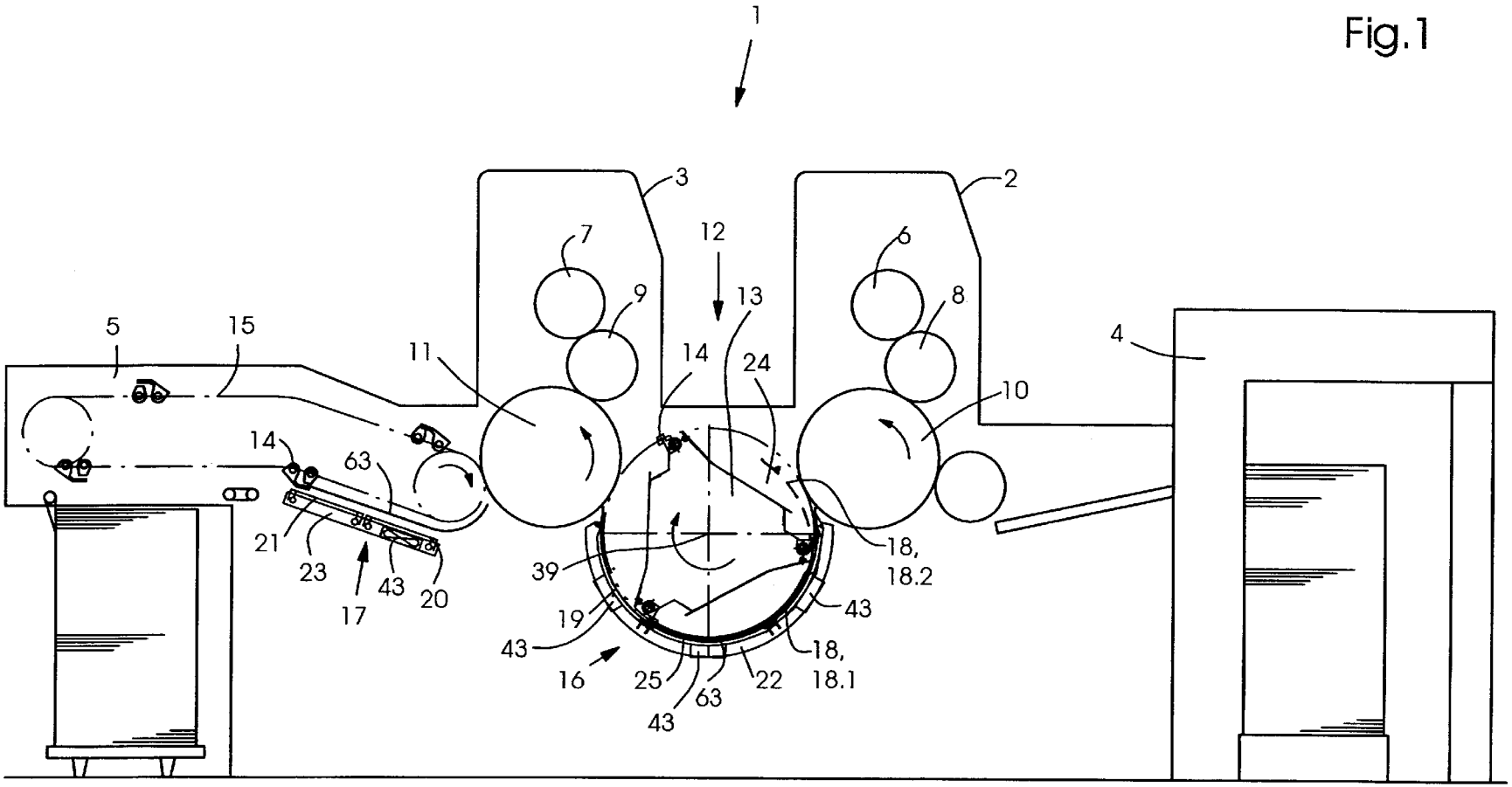
FIG. 1 is a diagrammatic side elevational view of a sheet-fed printing press with two sheet guiding devices according to the invention.

Referring now to the drawings and, first, particularly to FIG. 1 thereof, there is shown therein a sheet-fed printing press 1, embodied as a rotary sheet-fed printing press having a plurality of printing units 2 and 3, a sheet feeder 4, and a sheet delivery 5. Each printing unit 2, 3 includes a respective impression cylinder 10, 11, and a respective printing-form or plate cylinder 6, 7, and, in an embodiment wherein it is an offset printing unit, can include a respective rubber blanket cylinder 8, 9. The sheet of printing material is transported by a sheet transport device 12 from an upline printing unit 2 to a downline printing unit 3, the sheet transport device 12 including at least one sheet transport drum 13. The sheet transport drum 13 is embodied as an open transfer drum, having a cross-sectional geometry deviating from the circular form. If there are two diametrically opposed gripper rows 14, the sheet transport or transfer drum 13 can be orthorhombic in shape. In FIG. 1, there is shown a so-called triple-sized sheet transport drum 13, i.e., having a diameter three times the diameter of a conventional printing-unit cylinder, such as an impression, blanket or plate cylinder, the triple-sized drum 13 being provided with gripper rows, and having a cross-sectional shape that is substantially triangular. In the case of open transfer drums, stabilization of an especially lightweight printing material, such as thin paper, by a sheet guiding device and, in particular, a sheet guiding device provided with blower nozzles, is especially advantageous. A sheet guiding device 16, that is assemblable from a plurality of sheet guiding elements 18, 19 and 25, is assigned to the sheet transport drum 13. As viewed in the sheet transport direction, the second sheet guiding element 19 is disposed downline of the first sheet guiding element 18, and the third sheet guiding element 25 is inserted between the sheet guiding elements 18 and 19 that are embodied and disposed in a mirror-symmetrical relationship to one another. The sheet guiding elements 18, 19 and 25 are curved coaxially to the axis 39 of rotation of the sheet transport drum 13. In the case of a sheet transport drum with a circular cross section, the guide surfaces of the sheet guiding elements 18, 19 and 25 would extend equidistantly from the circumferential surface of the sheet transport drum, and in the illustrated sheet transport drum 13, embodied as an open transfer drum, the guide surfaces disposed on the sheet guiding elements 18, 19 and 25 and facing towards the sheet transport drum 13 are equidistant, over the entire guide path thereof, from the theoretical circumferential line or the path of gripper motion of the sheet transport drum 13. The sheet guiding elements 18, 19 and 25 have a common guide 22 assigned thereto, which facilitates the assembly of the sheet guiding device 16. Taking the sheet guiding element 18 as an example, FIG. 1 shows that the sheet guiding elements 18, 19 and 25 are introduced from above into the space below the sheet transport drum 13. To that end, the sheet guiding elements 18, 19 and 25 are passed through an intermediate space or interstice 24, formed between the sheet transport drum 13 and the impression cylinder 10 or the impression cylinder 11 and, in the process, are guided by the guide 22 in the circumferential direction of the sheet transport drum 13. The sheet guiding element 18, in the position 18.2 thereof shown in phantom or by dot-dash lines, represents this phase of assembling the sheet guiding device 16, whereas the sheet guiding element 18, in the position 18.1 thereof, has been assembled together with the other sheet guiding elements 19 and 25 and is in the operating position thereof. The sheet-fed printing press 1 includes a further sheet guiding device 17 that is associated with the delivery 5 and is disposed below a chain gripper system 15. The sheet guiding device 17 is assembled from rectilinearly formed sheet guiding elements 20 and 21. In contrast with the curved guide 22, the guide 23 has a rectilinear construction.

Except for the curvature, the sheet guiding elements 20 and 21 essentially correspond to the sheet guiding elements 18, 19 and 25. In other applications, instead of the sheet guiding device 16 with a concave curvature of the guide surface thereof, a convexly curved sheet guiding device can be provided. The dismantling and installation of the sheet guiding elements 18, 19 and 25 can be automated by providing for a take-up device on the sheet transport drum 13 to firmly hold the sheet guiding elements 18, 19 and 25, and to feed the sheet guiding elements 18, 19 and 25 out of the sheet-fed printing press 1 from the region below the sheet transport drum 13 by a rotation of the sheet transport drum 13. To facilitate the manipulation, suitable grips or handles, such as indentations to be grasped, may be provided on or in the respective sheet guiding elements 18, 19 and 25. The guides 22 and 23 serving for the reliable installation and removal of the sheet guiding elements 18, 19 and 25 and the firm mounting and exact positioning thereof are preferably embodied as rails and may also be formed as grooves, for example, in the side frame of the sheet-fed printing press 1. The sheet guiding elements 18 to 21 and 25 are preferably formed as a guide surface and can also be formed as mutually adjacent rods or as a grid. The sheet guiding elements 18 to 21 and 25 are preferably formed as suspension guides having blower nozzles which blow air towards the sheet of printing material 63 as it moves past. In this way, an air cushion can be formed under the sheet of printing material 63, which can simultaneously be aspirated or subjected to suction by the so-called Venturi effect in the direction of the sheet guiding elements 18 to 21 and 25, and stabilized along the path of motion thereof.

Figure 2:
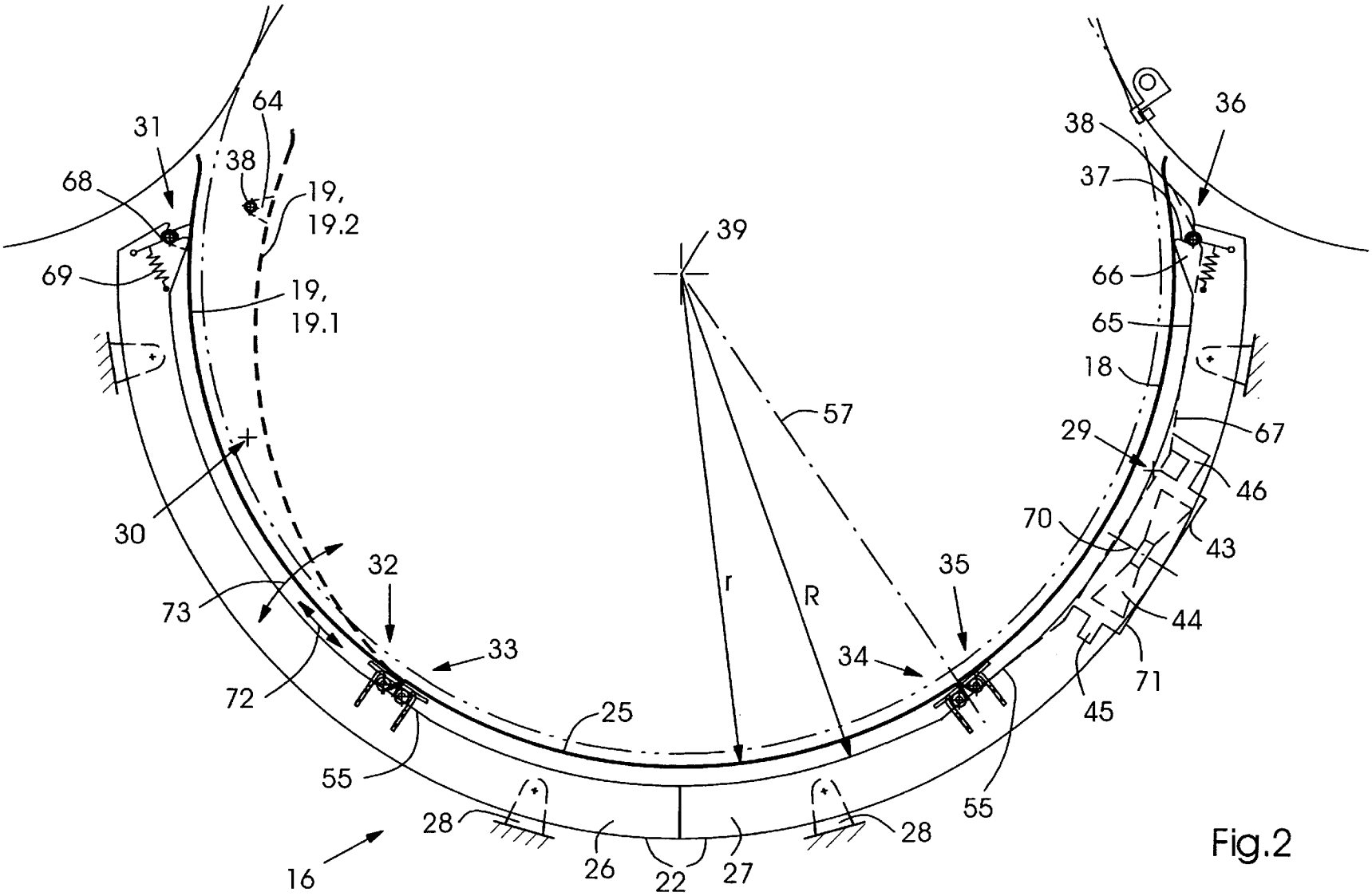
FIG. 2 is an enlarged fragmentary side elevational view of FIG. 1, showing one of the sheet guiding devices according to the invention in greater detail.

In FIG. 2, the sheet guiding device 16 associated with the sheet transport drum 13 is shown in detail. Viewed in the sheet transport direction, at least the first sheet guiding element 18 and the second sheet guiding element 19 are disposed after one another, and the third sheet guiding element 25 is preferably disposed between the sheet guiding elements 18 and 19. The guide 22 is composed of a plurality of guiding elements 26 and 27. The guide 22 is secured to the frame 28 of the sheet-fed printing press 1. The first sheet guiding element 18 and the second sheet guiding element 19, respectively, have a respective first mounting support 31, 36 and a respective second mounting support 32, 35. The third sheet guiding element 25 has two mounting supports 33 and 34 identical to one another, which are formed substantially like the mounting supports 32 and 35. The outer mounting supports 31 and 36 serve to secure the sheet guiding elements 18 and 19, respectively, in the position of use. The mounting supports 31 and 36 lock the sheet guiding elements 18 and 19 and block them from slipping in the guide 22. The third sheet guiding element 25, in the position for use, is held and fixed between the sheet guiding elements 18 and 19 by being contacted thereby on both sides. The mounting supports 31 and 36 fix the position of the sheet guiding elements 18, 19 and 25 in the circumferential direction of the sheet transport drum 13, and the mounting supports 32 to 35 fix the position of the sheet guiding elements 18, 19 and 25 in the radial direction, the mounting supports 31 to 36 having a form-locking effect. The first mounting supports 31 and 36, respectively, include one blocking part 38 and one blocking part seat 37. The blocking part 38 is preferably associated with the respective sheet guiding element 18, 19, while the blocking part seat 37 is associated with the guide 22, as is shown. Alternatively, the blocking part 38 may also be provided on the guide 22, while the blocking part seat 37 is provided on the respective sheet guiding element 18, 19. The blocking part seats 37 are preferably embodied as clawlike recesses, open at the top, which are formed by a sawtooth-shaped element 66 with an obliquely upwardly directed seat surface. This seat surface, together with a second seat surface, forms a hollow throat for the insertion therein of the blocking part 38, that is preferably formed as a pin. The blocking parts 38 are disposed below the respective sheet guiding elements 18 and 19 and are connected thereto. When a radial fan 43 for the applicable sheet guiding element 18, 19 is present in a chest 67 disposed below the respective sheet guiding element 18, 19, the blocking part 38 may be secured to the chest 67. This is shown by way of example with respect to the sheet guiding element 18. If there is no such chest 67, then a carrier 64 that carries the blocking part 38 may be provided on the underside of the sheet guiding element 18, 19, as is shown by way of example with respect to the sheet guiding element 19. The blocking part seats 37 may also be formed as a take-up groove or saddle, and the blocking parts 38 may be suitably formed as a lug, mandrel or locking bar. The blocking part 38 is partly surrounded by the blocking part seat 37 in a detent position.

Figure 4:
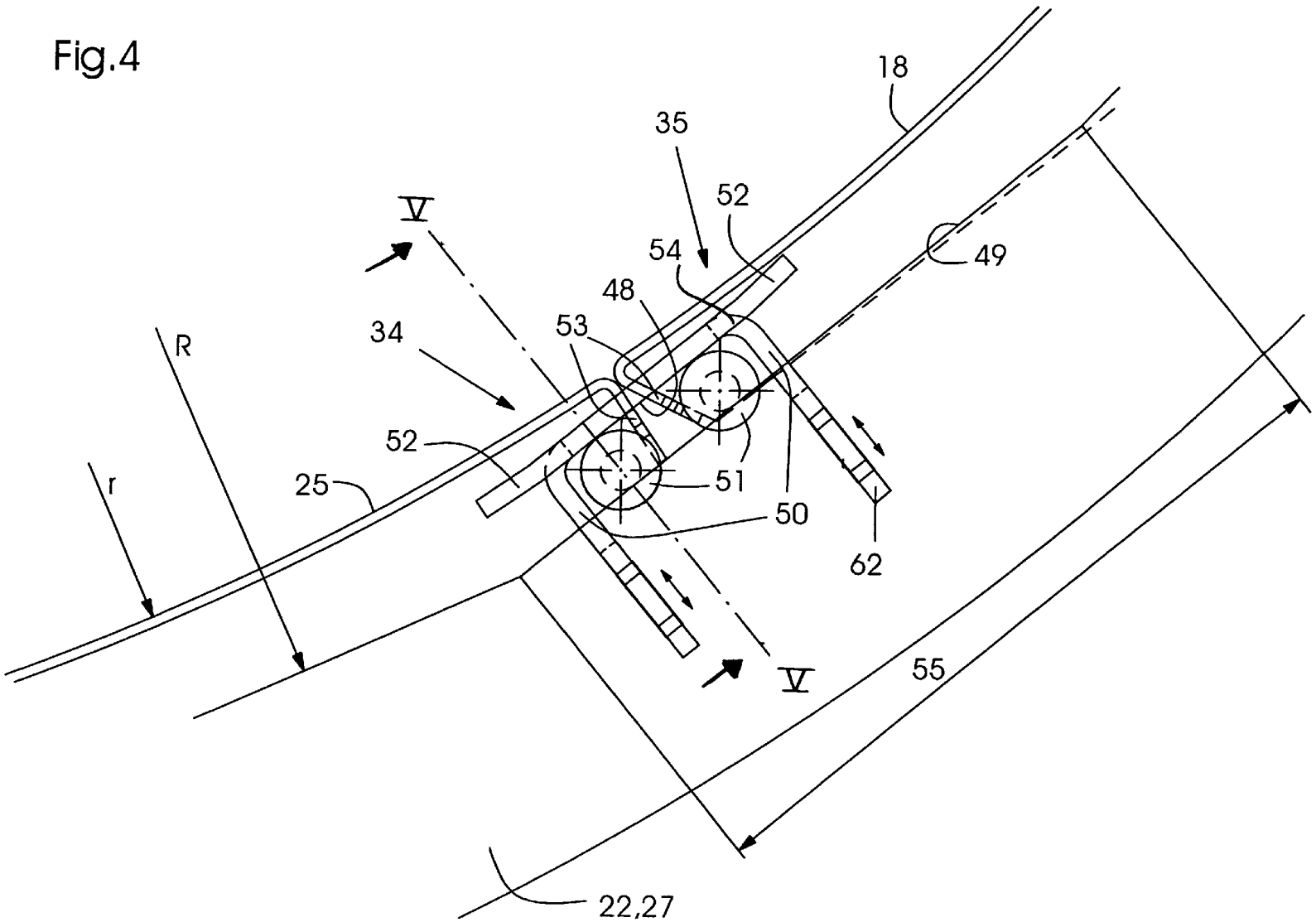
FIG. 4 is an enlarged fragmentary view of FIG. 2 showing mounting supports for the sheet guiding device.

Due to the form and construction of the mounting supports 31 and 36, which function as traps, and the location of the respective center of gravity 29, 30, assurance is provided that the respective sheet guiding elements 18 and 19 will always roll or slide automatically along the guide 22 and drop into the correct terminal position, even if the sheet guiding elements 18 and 19 have not been placed precisely during assembly. The sheet guiding elements 18, 19 and 25 remain in the terminal position by their own weight but, nevertheless, additional securing of the sheet guiding elements 18 and 19 may be provided, in the form of a locking device, such as a hook 68, for example, that is prestressed by a spring, and surrounds the blocking part 38, in order, with absolute certainty, to prevent the sheet guiding elements 18 and 19 from slipping out. The hooks 68 are briefly pushed away by the blocking parts 38 when the latter enter the detent position thereof, and the hooks 68 are snapped back by the springs, so that the blocking parts 38 practically drop into a lock. Instead of the hooks 68, indexing bolts or bayonet mounts may be used. The blocking parts 38 and the guide parts 51 are constructed, in terms of the shape thereof, with respect to the guide 22 in such a manner that the blocking parts 38 and guide parts 51 (FIG. 5) are prevented from sliding out laterally (perpendicularly to the plane of the drawing) and being displaced in the guide 22, respectively, and these elements slide or roll well on and in the guide 22, respectively. The second mounting supports 32 and 35 are constructed as turning and sliding joints, which enable a displacement, in the directions of the doubleheaded arrow 72 of the sheet guiding elements 18, 19, along the guide 22, and a pivoting, in the direction of the curved double-headed arrow 73, of the sheet guiding elements 18 and 19 about an axis, namely the guide part 51 (FIG. 5) forming a pivot pin, that extends parallel to the rotational axis 39 of the sheet transport drum 13. The pivoting motion is represented in FIG. 2, by way of example, with respect to the sheet guiding element 19, that is pivotable out of the position 19.2, represented by a broken line, into the position 19.1, located between the guide faces 48 and 49 (FIG. 4). The pivoting motion can, with a shim, be accomplished solely by the action of gravity on the sheet guiding elements 18 and 19, so that they are locked with certainty in the correct position 19.1 thereof. This is assured both in the sheet guiding element 19 shown here as such, by way of example, without a fan or blower, with the center of gravity position 30, and in the sheet guiding element 18, shown by way of example here with the fan or blower 43 and with the center of gravity position 29. The mounting supports 33 and 34 are embodied like the mounting supports 32 and 35, the pivoting function for positioning the sheet guiding element 25 being not absolutely necessary. The mounting supports 32 to 35 are embodied as releasable jointed connections, which can be undone again without using tools. Due to the aforedescribed features, the sheet guiding elements 18, 19 and 25 can be introduced reliably and easily into the press and are fixed in the operating position with very high precision, no tools being necessary and no adjusting effort being required for putting the sheet guiding device 16 together and for taking it apart.

Figure 3:
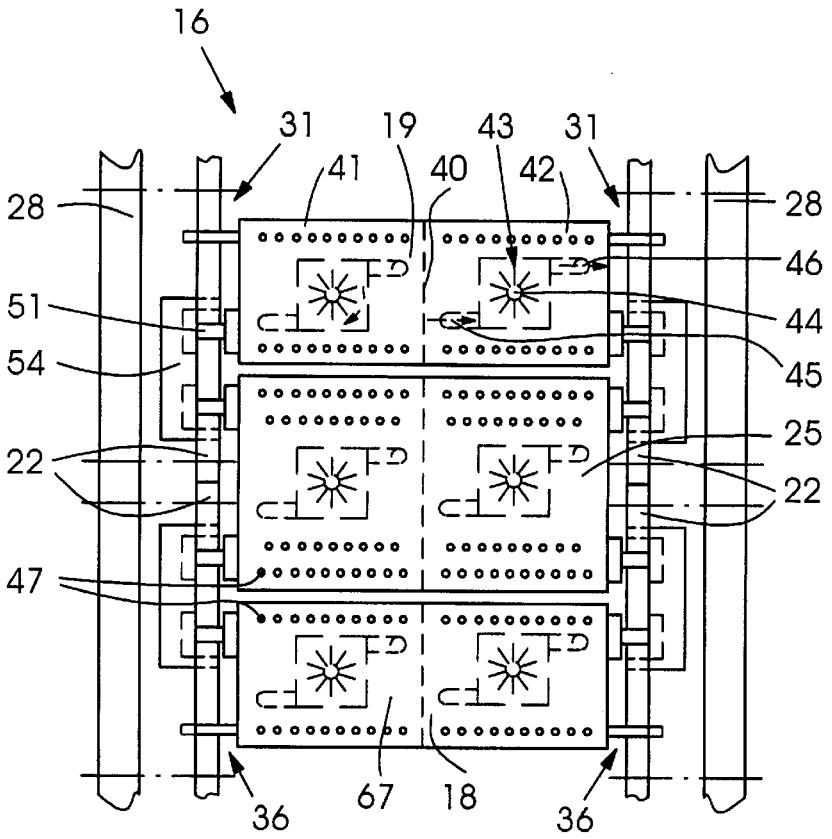
FIG. 3 is a top plan view of FIG. 2, showing the sheet guiding device with the sheet transfer drum omitted.

In FIG. 3, the sheet guiding device 16 is shown from above with the sheet transport drum 13 removed. Shown therein is the arrangement of the guide 22 and the construction of the mounting supports 31 to 36 on both sides of the sheet guiding elements 18, 19 and 25 as described in conjunction with FIG. 2. The sheet guiding elements 18, 19 and 25 are embodied as sheet guide baffles provided with nozzles 47. FIG. 3 also shows that each of the sheet guiding elements 18, 19 and 25 can be equipped with the fan 43, and the fans 43 are disposed directly on the respective sheet guiding elements 18, 19 and 25, and expansions of the fan housings, formed in chests 67 and communicating air-conductively with the chambers 41 and 42, are located below the sheet guiding elements 18, 19 and 25. Instead of the mounting the fans 43 outside the chambers 41 and 42 in the fan housing 71 (FIG. 2) as shown, the fans may be integrated with the chambers 41 and 42. Mounting the fans 43 directly on the sheet guiding elements 18, 19 and 25 has the advantage, over externally disposed fans that communicate with the sheet guiding elements through hoses, that high efficiency is achieved and pressure losses are avoided. A plurality of fans 43 are assigned to each sheet guiding element 18, 19, 25. In this way, a constant pressure level is assured over the entire surface area of the respective sheet guiding element 18, 19, 25. Constant air pressure distribution can also be achieved by the use of a single radial fan or a plurality of radial fans. This type of fan can be controlled very well and demands very little energy, compared with axial fans. Furthermore, the structural size of the radial fans is less than that for axial fans that generate a comparable blown air pressure. The chests 67 of the sheet guiding elements 18, 19 and 25 are preferably subdivided by one or more partitions 40 into various chambers 41 and 42, with at least one fan 43 disposed in each chamber 41, 42. In FIG. 3, sheet guiding elements 18, 19 and 25, respectively, subdivided into two chambers 41 and 42 are shown, and each chamber 41, 42 is supplied with compressed air by a radial fan 43 separately assigned to that chamber 41, 42. Due to the supplying of air to various chambers 41 and 42 which are separate from one another, by this separately assigned fan 43, mutual influence of the fans 43 from cyclical pressure fluctuations caused by fluidic conditions is avoided, the chambers 41 and 42 belonging to a given sheet guiding element 18, 19, 25 being thus able to be given a like size and a like volume, so that pressure fluctuations are practically precluded. Each radial fan 43 includes a fan and blower wheel 44, respectively, for blowing the air, aspirated through an air inlet 45, not in the direction of the rotational axis 70, but rather in the radial direction, through an air outlet 46, into the respective chest 67 and into the corresponding chamber 41, 42, respectively. The radial fans or blowers 43 combine the capability of being mounted directly on the sheet guiding elements 18, 19 and 25 with the capability of furnishing a sufficiently high and uniform pressure level. This is highly advantageous, especially if the sheet guiding elements 18, 19 and 25 are embodied as Venturi nozzle plates. The guide surfaces of the sheet guiding device 16 which are provided with the nozzles 47 are formed by the walls of the chambers 41 and 42.

In FIG. 4, the mounting supports 34 and 35 are shown enlarged over the view thereof in FIG. 3 and, in the interest of greater clarity and simplicity, the sheet guiding elements 18 and 25 are shown without the appertaining chests 67 and fans or blowers 43. The second mounting support 35 includes two guide surfaces 48 and 49 extending parallel to one another, as well as the guide part 51 guided therebetween. The guide surface 49 is formed on the guide 22, that is embodied as a bearing rail, and the guide surface 48 is formed on the counterpart 52 to the guide 22. The mounting support 34, that substantially corresponds to the second mounting support 35, is constructed in a like manner. The guide parts 51 with a round profile can be inserted between the guide 22 and the counterpart 54 and thus between the respective guide surfaces 48 and 49, the slight facets or chamfering angles and counterpart angles 52, respectively, away from the guide 22 serving the purpose of catching and introducing the guide parts 51. With the sheet guiding elements 18 and 25 in position, the guide part 51 is enclosed by the counterpart 54 and the guide 22 and fixed so that the guide parts 51 and the sheet guiding elements 18 and 25 are then movable only along the guide 22. The guide surfaces 48 and 49 are preferably of rectilinear construction, as shown. This embodiment is quite economical. The curved guide 22 with the radius R is provided for that purpose with a rectilinear region 55 whereon the guide parts 51 of both sheet guiding elements 18 and 25, disposed behind one another, rest in the operating positions thereof. The rectilinear region 55 and the guide surface 49 thereof, respectively, form a secant of the curved guide 22. The curved shape of the guide 22 corresponds to a concave pitch circle that is determined by the radius R and spans the secant. The counterpart 54 is disposed facing the rectilinear region 55. It is also possible for the guide surfaces 48 and 49 to be formed so that they extend curved and parallel to one another, for example, being circular and concentric with one another, in which case, the secantlike camber of the guide 22 can be omitted. The counterpart 54 is carried by a carrier 50, that is formed of two ribs. The carrier 50 is fastened to the guide 22. The counterpart 54 can be adjusted very precisely with regard to the spacing and parallelism to the guide 22 by the adjusting device 62. As a rule, a single one-time adjustment is provided in the production of the sheet guiding device, but readjustment is possible at any time, so that the guide parts 51 are guided sufficiently tautly between the guide surfaces 48 and 49, without rattling. The ends of the sheet guiding elements 18 and 25 are bent at an angle, the bend 53 of the sheet guiding element 25 being approximately at a right angle to the guide plane, and the bend 53 of the sheet guiding element 18 being at an acute angle to the guide plane, resulting in an approximately 60° angle. The ends of the sheet guiding elements 18 and 25 having the bends 53 rest on one another when the sheet guiding elements 18 and 25 are in operating position. The guide parts 51 are secured to the sheet guiding elements 18 and 25, preferably directly on the ends 53 thereof, and can be welded thereto. The guide parts 51 preferably slide on the guide 22, as shown. Guide parts 51 supported rotatably in the sheet guiding elements 18 and 25 may also be provided, and can then roll off on the guide 22. The mounting support 31 is constructed identically to the afore-described mounting support 34, and the mounting support 32 is constructed identically to the mounting support 35, the mounting supports 32 and 35 being again embodied as double mounting supports.

Figure 5:
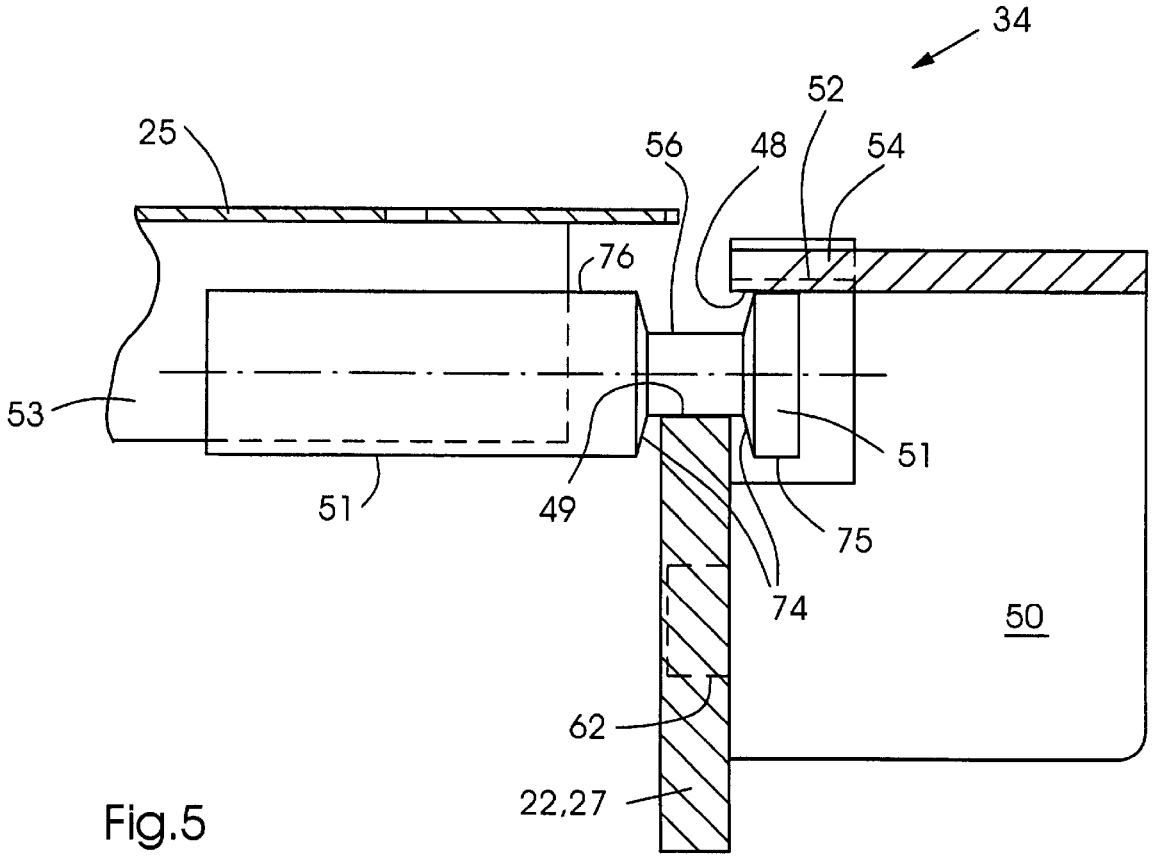
FIG. 5 is an enlarged fragmentary cross-sectional view of FIG. 4 taken along the line V—V in the direction of the arrows, and showing one of the mounting supports.

In FIG. 5, the mounting support 34 is shown in a sectional view taken in the sheet transport direction. The mounting supports 32, 33 and 35 are embodied identically to the mounting support 34 described hereinafter. The guide part 51 is preferably embodied as a bolt and can also be embodied as a sliding block. The guide part 51 has a groove, the bottom of which rests on the guide surface 49. In the profiled guide part 51 shown, the groove is an annular groove and forms a tapered shoulder 56 of the guide part 51 embodied as an offset bolt. Side surfaces 74 of the guide part 51 secure the guide part 51 against shifting laterally. The mounting support 34, just like the mounting supports 31 to 33, 35 and 36 on the respective sheet guiding element 18, 19, 25, is disposed doubled, namely on the opposite side, as well, preferably in mirror symmetry and in an aligned arrangement (FIG. 3). Lateral fixation of the sheet guiding elements 18, 19 and 25 is thus also provided where there is a shoulder 56, defined by only one side surface 74, per mounting support 34, on each side of the sheet guiding elements 18, 19 and 25, for example, when only the inner or only the outer side surfaces 74 are present. In that case, respectively, one of the shoulders 75 and 76 may be formed with a diameter equal to or less than the diameter of the tapered shoulder 56. A construction of two side surfaces 74 enclosing the shoulder 56, however, makes possible a more favorable contact of the guide parts 51 with the rail-like guide 22 before the sheet guiding elements 18, 19 and 25 are introduced into the press. The width of the guide surface 49 is preferably somewhat less than the width of the shoulder 56. The guide surfaces 48 and 49 guide the guide part 51 at locations offset from one another in the axial direction. The counterpart 54 is preferably fastened to the bracketlike carrier 50 or made integral therewith.

Figure 6:
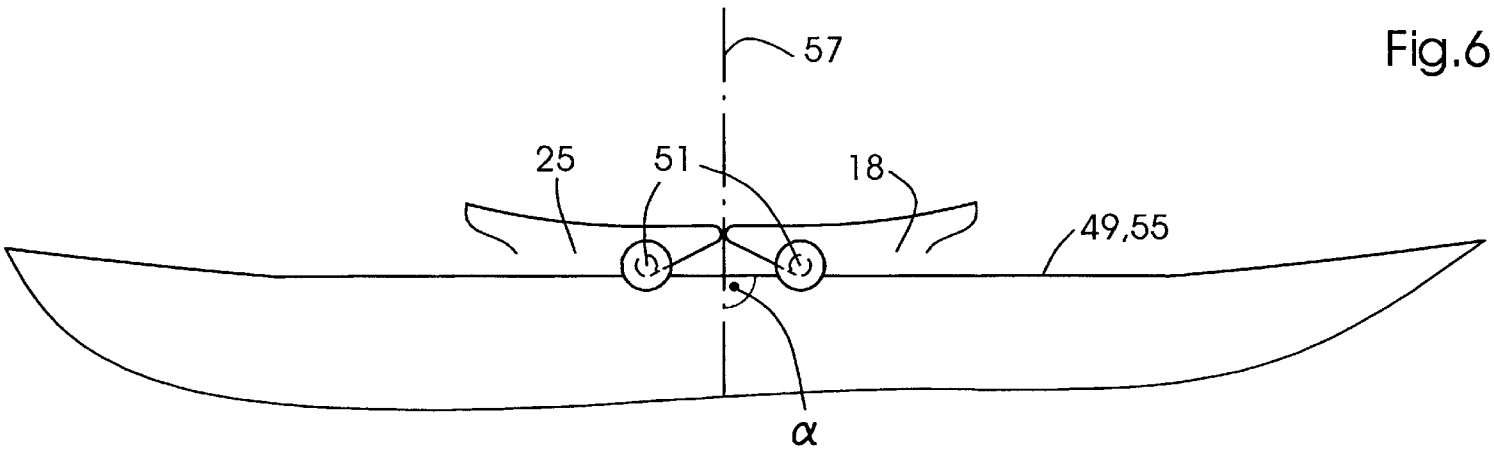
FIG. 6 is a highly diagrammatic view of FIG. 5, showing the sheet guiding elements in positions relative to one another.

In FIG. 6, a possible relative position of the sheet guiding elements 18, 19 and 25 to one another is shown, in which the straight region 55 forms a right angle with the center line 57, which is equivalent to the radius of curvature R of the guide 22. In an arrangement with equal spacing of the guide parts 51 from the guide surface of the sheet guiding elements 18 and 25, the guide surfaces of those elements are located in the same plane, in the dividing or dismantling location defined by the center line 57.

Figure 7:
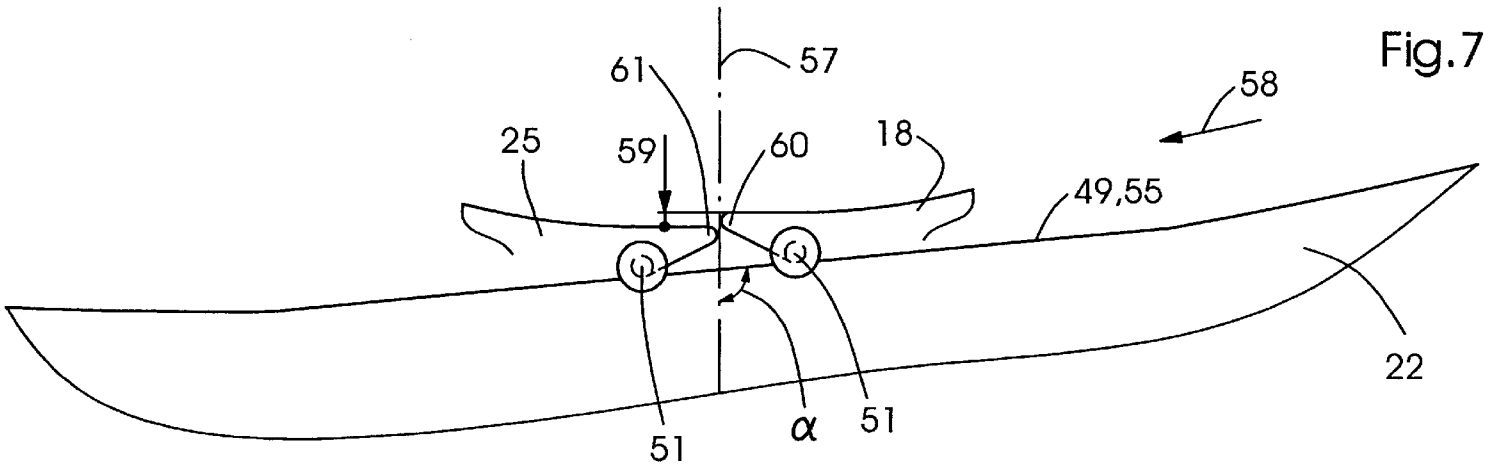
FIG. 7 is a view similar to that of FIG. 6, wherein the sheet guiding elements are in different positions relative to one another.

In FIG. 7, a construction of the dividing location of the sheet guiding elements 18 and 25 that is possible and preferred for all of the sheet guiding elements 18, 19 and 25 contacting one another is shown diagrammatically.

In the preferred embodiment shown in FIG. 7, the leading edge 60 of the first sheet guiding element 18 protrudes, in terms of the sheet transport direction represented by the arrow 58, past the trailing edge 61 of the third sheet guiding element 25, preceding the first sheet guiding element 18 in the sheet transport direction 58, and is raised a distance 59, for example, a distance 0.5 to 1.0 mm therefrom. By a displacement of the guide parts 22 during factory assembly of the sheet guiding elements 18, 19 and 25 along the region 55, a very accurate fine adjustment of the spacing 59 from 0 mm (FIG. 6) to 3 mm, for example, is possible. This is attained by providing an angle α between the region 55 and the center line 57 that is different from the corresponding angle α of FIG. 6 and which in FIG. 7 is an obtuse angle α, i.e., α>90°. As a result, the inclination of the straight region 55 relative to the center line 57 and to the radius of curvature R of the guide 22 is changed. The offset of the sheet guiding elements 18, 19 and 25 from one another can also be produced by a corresponding offsetting of the guide parts 51, in which case, the right angle α shown in FIG. 6 being maintainable. However, the construction shown in FIG. 7 permits an especially uncomplicated adjustment of the sheet guiding elements 18, 19 and 25 to be made.

We claim:

1. A sheet guiding device, comprising a plurality of sheet guiding elements including at least a first sheet guiding element and a second sheet guiding element, said sheet guiding elements, in an assembled state thereof, defining a sheet guiding assembly for guiding sheets of printing material in a sheet-fed printing press, and a guide for guiding at least one of said sheet guiding elements as the sheet guiding elements are being mutually assembled.

2. The sheet guiding device according to claim 1, wherein the first sheet guiding element and the second sheet guiding element, respectively, have a first mounting support and a second mounting support.

3. The sheet guiding device according to claim 2, wherein each of said first mounting supports includes a blocking part and a blocking part seat.

4. The sheet guiding device according to claim 2, wherein at least one second mounting support is embodied as a turning and sliding joint.

5. The sheet guiding device according to claim 2, including at least one third sheet guiding element insertable between the first and the second sheet guiding elements, and guidable by said guide as the first and the second sheet guiding elements and said third sheet guiding element are being mutually assembled, said third sheet guiding element having two mounting supports embodied like said second mounting support of the first and the second sheet guiding elements.

6. The sheet guiding device according to claim 1, wherein said sheet guiding elements include further sheet guiding elements and said guide is adapted to guide a plurality of said sheet guiding elements as they are being mutually assembled to form the sheet guiding assembly.

7. The sheet guiding device according to claim 6, including at least one third sheet guiding element insertable between said first sheet guiding element and said second sheet guiding element, and guidable by said guide as said first and second sheet guiding elements and said third sheet guiding element are being mutually assembled.

8. The sheet guiding device according to claim 1, wherein at least one of the sheet guiding elements is formed so as to be self-locking while the sheet guiding elements are being mutually assembled.

9. The sheet guiding device according to claim 1, wherein the first sheet guiding element and the second sheet guiding element are assigned to one of a sheet transport drum and a cylinder for guiding a sheet of printing material.

10. The sheet guiding device according to claim 9, wherein said guide is formed so as to curve concentrically around the one of said sheet transport drum and said cylinder.

11. The sheet guiding device according to claim 1, wherein at least one of the sheet guiding elements is disposed so that, as viewed in sheet transport direction, a leading edge thereof is offset, in a direction of a normal to a sheet guide plane, from a trailing edge of a sheet guiding element preceding the one sheet guiding element in the sheet transport direction.

12. The sheet guiding device according to claim 1, wherein at least one of the sheet guiding elements is embodied as a sheet guiding baffle provided with nozzles, and including a radial fan for supplying said nozzles with blown air.

13. A printing press having at least one of the sheet guiding devices according to claim 1.

14. In a sheet-fed rotary printing machine with a cylinder about which a sheet-transport path is defined in the printing machine, a sheet guiding device for guiding sheets along the sheet-transport path, comprising a plurality of sheet guiding elements including at least a first sheet guiding element and a second sheet guiding element, said sheet guiding elements, in an assembled state thereof, defining a sheet guiding assembly curved around a cylinder of the printing machine for guiding sheets of printing material around the cylinder, and a guide for guiding at least one of said sheet guiding elements as the sheet guiding elements are being mutually assembled.

* * * * *